US012599832B2

(12) United States Patent
Schembs et al.

(10) Patent No.: US 12,599,832 B2
(45) Date of Patent: Apr. 14, 2026

(54) AUTOMATIC UMPIRING SYSTEM

(71) Applicant: Musco Corporation, Oskaloosa, IA (US)

(72) Inventors: Andrew J. Schembs, Johnston, IA (US); Alireza Razavi, West Des Moines, IA (US); Amir Niaraki, Des Moines, IA (US); Jay L. Guild, Urbandale, IA (US)

( * ) Notice: Subject to any disclaimer, the term of this patent is extended or adjusted under 35 U.S.C. 154(b) by 246 days.

(21) Appl. No.: 18/520,967

(22) Filed: Nov. 28, 2023

(65) Prior Publication Data

US 2024/0173608 A1 May 30, 2024

Related U.S. Application Data

(60) Provisional application No. 63/385,068, filed on Nov. 28, 2022.

(51) Int. Cl.
*A63B 71/06* (2006.01)

(52) U.S. Cl.
CPC ..... *A63B 71/06* (2013.01); *A63B 2071/0694* (2013.01); *A63B 2220/806* (2013.01)

(58) Field of Classification Search
CPC ..... A63B 71/06; A63B 2071/0694; A63B 2220/806
See application file for complete search history.

(56) References Cited

U.S. PATENT DOCUMENTS 4,545,576 A 10/1985 Harris
5,401,016 A 3/1995 Heglund et al.
6,634,967 B2 10/2003 Daniel
8,885,886 B2 11/2014 Daniels et al.
9,589,332 B2 3/2017 Daniels et al.
9,646,382 B2 5/2017 Hawkins
(Continued)

FOREIGN PATENT DOCUMENTS

TW 1274507 B 5/2005
TW 1388355 B1 3/2013
(Continued)

OTHER PUBLICATIONS

Company Report, Hawk Eye Sensors, 2021-09-01, 25 pages, insights.patsnap.com.
(Continued)

*Primary Examiner* — Reginald A Renwick
(74) *Attorney, Agent, or Firm* — Kurt J. Fugman; Zachary S. Pratt

(57) ABSTRACT

A system for creating an artificial strike zone is disclosed. One or more cameras, such as a first camera and a second camera, are installed on a sports field, wherein the first camera is installed at a first location, and the second camera, when installed, is installed at a second location. Each camera is directed at a common focal point. Each camera captures an individual video stream. Processors detect a batter near the common focal point in at least one of the video streams and construct a virtual strike zone above the common focal point and in front of the batter based on each of the individual video streams, one or more stance characteristics of the batter, and one or more physical characteristics of the batter. A width of the strike zone is drawn based on and in relation to the width of the common focal point.

28 Claims, 5 Drawing Sheets

(56) References Cited

U.S. PATENT DOCUMENTS

| | | | | |
|---|---|---|---|---|
| 10,410,068 | B2 | 9/2019 | Dodd et al. | |
| 10,788,327 | B2 | 9/2020 | Hawkins et al. | |
| 11,305,174 | B2 | 4/2022 | Spivak et al. | |
| 11,707,663 | B1 | 7/2023 | Hall | |
| 2005/0012023 | A1 | 1/2005 | Vock et al. | |
| 2016/0307335 | A1* | 10/2016 | Perry | G06T 7/292 |
| 2017/0100658 | A1* | 4/2017 | Tally | A63B 69/0002 |
| 2017/0151481 | A1 | 6/2017 | Divine | |
| 2017/0200277 | A1 | 7/2017 | Keat et al. | |
| 2017/0333777 | A1* | 11/2017 | Spivak | G06V 20/42 |
| 2018/0272224 | A1* | 9/2018 | Chen | G06V 40/28 |
| 2020/0009441 | A1* | 1/2020 | Divine | A63B 71/0619 |
| 2021/0125349 | A1* | 4/2021 | Song | G01S 5/16 |
| 2021/0133983 | A1 | 5/2021 | Hayashi et al. | |
| 2021/0283487 | A1* | 9/2021 | Cherryhomes | A63B 71/0622 |
| 2021/0319618 | A1 | 10/2021 | Lee et al. | |
| 2023/0040575 | A1* | 2/2023 | Ungstrup | G06T 7/20 |
| 2024/0173608 | A1* | 5/2024 | Schembs | A63B 71/06 |
| 2025/0029387 | A1* | 1/2025 | Hall | G06V 10/25 |

FOREIGN PATENT DOCUMENTS

| | | | |
|---|---|---|---|
| WO | 2001041884 | A1 | 6/2001 |
| WO | 2001054781 | A2 | 8/2001 |
| WO | 2020101094 | A1 | 5/2020 |

OTHER PUBLICATIONS

Technology Report, IN: (Paul hawkins) and all_an: (Sony), Sep. 1, 2021, 35 pages, insights.patsnap.com.

* cited by examiner

AUTOMATIC UMPIRING SYSTEM

RELATED APPLICATIONS

This application claims the benefit of U.S. Provisional Application No. 63/385,068, filed Nov. 28, 2022, the entire contents of which are incorporated herein by reference.

TECHNICAL FIELD

The disclosure relates to a camera system for providing umpiring services.

BACKGROUND

Throughout the world of sports, there is an increasing frustration with the human error inherent with officiating sporting contests. With the availability of instant reply, high-definition cameras, and social media, officials are under immense pressure to get calls correct, or else face the wrath of unruly parents or social media scorn. Attempts have been made to automate this process, but certain sports, such as baseball and softball, are still largely subject to human officials. Broadcasts of these games have begun including fan aids by placing a generic strike zone graphic above home plate and an estimate of a pitch location on a screen, but these are largely estimations or universal graphics and are only viewed by fans over a broadcast.

SUMMARY

In general, the disclosure is directed to a system of cameras and processors that creates a virtual strike zone and has the capability to automatically umpire a baseball or softball game. With one or more cameras pointed at a common focal point, such as home plate, the cameras can send video streams to the processors. The processors can analyze the video streams to identify at least a batter and, eventually, a sports ball. The processors can further analyze the batter to determine a virtual strike zone for the batter based on characteristics specific to that batter. The processors can also further analyze the sports ball to track the path of the sports ball, at least as it nears home plate. The processors can determine if the path of the sports ball crosses through the virtual strike zone and communicate the result of the pitch to an official at the field.

In this way, the techniques of this disclosure describe a fair and customized approach to automating one of the most difficult jobs a human official can have. As opposed to placing a generic graphic on a broadcast for a fan's view, the system described herein can interface directly with an official to automate a call based on unbiased video evidence that can be analyzed completely in real time or near real-time. The system described herein is fair by removing any potential bias from the calls and can streamline the process of calling a baseball or softball game. Additionally, the techniques described herein can be performed with a single camera (although optimally through the use of two or more cameras), reducing the costs of the system and enabling the system to be implemented on a smaller scale, such as youth league fields.

In one example, the disclosure is directed to a method that includes installing, on a sports field, one or more cameras. In some instances, a plurality of cameras are installed, including at least a first camera and a second camera, wherein the first camera is installed at a first location, and wherein the second camera is installed at a second location different than the first location. The method further includes directing each of the plurality of cameras at a common focal point. The method also includes capturing an individual video stream by each of the plurality of cameras. The method further includes detecting, by one or more processors, a batter near the common focal point in each of the individual video streams. The method also includes constructing, by the one or more processors, a virtual strike zone above the common focal point and in front of the batter based at least in part on each of the one or more individual video streams, one or more stance characteristics of the batter, and one or more physical characteristics of the batter.

In another example, the disclosure is directed to a device comprising a non-transitory computer-readable storage medium and one or more processors. The one or more processors are configured to control one or more cameras to each capture an individual video stream, each of the one or more cameras being directed at a common focal point on a sports field. The one or more processors further detect a batter near the common focal point in each of the individual video streams. The one or more processors also construct a virtual strike zone above the common focal point and in front of the batter based at least in part on each of the individual video streams and one or more of one or more stance characteristics of the batter and one or more physical characteristics of the batter.

In another example, the disclosure is directed to an apparatus comprising means for performing any combination or portion of the methods described herein.

In another example, the disclosure is directed to a non-transitory computer-readable storage medium having stored thereon instructions that, when executed, cause one or more processors of a computing device to control one or more cameras to each capture an individual video stream, each of the one or more cameras being directed at a common focal point on a sports field. The instructions further cause the one or more processors to detect a batter near the common focal point in each of the individual video streams. The instructions also cause the one or more processors to construct a virtual strike zone above the common focal point and in front of the batter based at least in part on each of the individual video streams and one or more of one or more stance characteristics of the batter and one or more physical characteristics of the batter.

In another example, the disclosure is directed to a system comprising one or more computing devices configured to perform any combination or portion of the methods described herein.

In another example, the disclosure is directed to any of the techniques described herein.

The details of one or more examples of the disclosure are set forth in the accompanying drawings and the description below. Other features, objects, and advantages of the disclosure will be apparent from the description and drawings, and from the claims.

BRIEF DESCRIPTION OF DRAWINGS

The following drawings are illustrative of particular examples of the present disclosure and therefore do not limit the scope of the invention. The drawings are not necessarily to scale, though examples can include the scale illustrated, and are intended for use in conjunction with the explanations in the following detailed description wherein like reference characters denote like elements. Examples of the present disclosure will hereinafter be described in conjunction with the appended drawings.

DETAILED DESCRIPTION

The following detailed description is exemplary in nature and is not intended to limit the scope, applicability, or configuration of the techniques or systems described herein in any way. Rather, the following description provides some practical illustrations for implementing examples of the techniques or systems described herein. Those skilled in the art will recognize that many of the noted examples have a variety of suitable alternatives.

Figure 1:
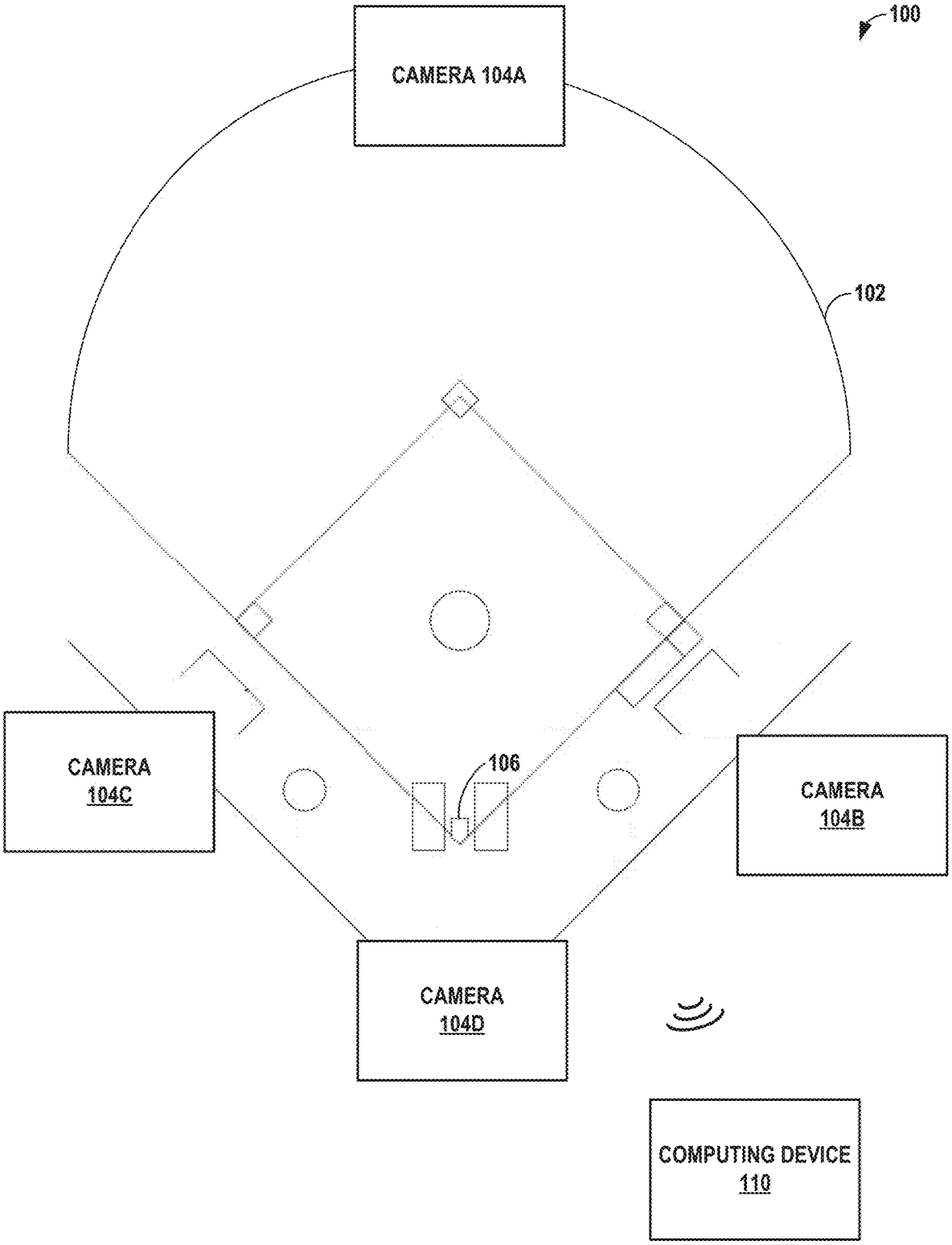
FIG. 1 is a conceptual diagram illustrating of a sports field with cameras installed on location for creating a virtual strike zone, in accordance with one or more techniques described herein.

FIG. 1 is a conceptual diagram illustrating automatic umpiring system 100 that includes sports field 102 with cameras 104A-104D (collectively, cameras 104) installed on location for creating a virtual strike zone, in accordance with one or more techniques described herein. While the example of FIG. 1 illustrates automatic umpiring system 100 with four instances of cameras 104, other instances of automatic umpiring system 100 may include more cameras or fewer cameras. For instance, automatic umpiring system may only include cameras 104A and 104B, cameras 104A and 104C, cameras 104A-C, or any other combination of cameras, including only camera 104B or 104C if those cameras are stereoscopic cameras (e.g., camera 104B is a system of two cameras arranged to function as a stereoscopic system).

Computing device 110 may be any computer with the processing power required to adequately execute the techniques described herein. For instance, computing device 110 may be any one or more of a mobile computing device (e.g., a smartphone, a tablet computer, a laptop computer, etc.), a desktop computer, a smarthome component (e.g., a computerized appliance, a home security system, a control panel for home components, a lighting system, a smart power outlet, etc.), a wearable computing device (e.g., a smart watch, computerized glasses, a heart monitor, a glucose monitor, smart headphones, etc.), a virtual reality/augmented reality/extended reality (VR/AR/XR) system, a video game or streaming system, a network modem, router, or server system, or any other computerized device that may be configured to perform the techniques described herein.

Cameras 104 may be any camera capable of recording a video stream and transmitting that video stream to computing device 110, either wirelessly or through a wired connection. Each of cameras 104 may be directed at home plate 106 such that home plate 106 is a common focal point in each of the video streams recorded by the respective one of cameras 104, meaning that home plate 106 is present and visible in the video streams at least when no obstructions are on sports field 102.

In accordance with the techniques described herein, a user or a system may install, on sports field 102, a plurality of cameras including at least first camera 104A and second camera 104B. The first camera is installed at a first location (e.g., an outfield location approximately in front of focal point 106), and the second camera is installed at a second location different than the first location (e.g., to one of a first base side or a third base side of focal point 106). The user or system directs each of the plurality of cameras at focal point 106. Each of the cameras captures an individual video stream. Computing device 110 detects a batter near focal point 106 in each of the individual video streams. Computing device 110 constructs a virtual strike zone above the common focal point and in front of the batter based at least in part on each of the individual video streams and one or more of one or more stance characteristics of the batter and one or more physical characteristics of the batter. In some instances, only a first camera, such as camera 104A installed in a center field area of sports field 102, may be utilized in constructing the virtual strike zone described herein.

In an example, a view from one of camera 104B and 104C may detect whether the batter is righthanded or lefthanded. For lefthanded batters, computing device 110 may prioritize a video stream from camera 104C, as camera 104C would include an unobstructed view of the batter and home plate 106. Conversely, for righthanded batters, computing device 110 may prioritize a video stream from camera 104B, as camera 104B would include an unobstructed view of the batter and home plate 106. Camera 104A may have an unobstructed view straight on of both the batter and home plate 106 regardless of the handedness of the batter.

Computing device 110 may receive a video stream from camera 104A in an outfield of sports field 102 to create the virtual strike zone. Using image analysis from the streams from side cameras 104B and/or 104C and outfield camera 104A, computing device 110 may detect certain landmarks on the batter, including one or more of a shoulder, a chest, a hip, and/or a knee. Computing device 110 may use these landmarks to create a top and bottom boundary of the virtual strike zone. Computing device 110 may also identify home plate 106, creating side boundaries for the virtual strike zone based on home plate 106.

Computing device 110 may detect from one or more video streams from any of cameras 104 that a pitcher is beginning their pitching motion. Computing device 110 may identify the ball leaving the pitcher's hand and track the ball through the video streams at some point between the pitcher's mound and home plate 106. In some instances, computing device 110 may additionally calculate a speed of the ball during the pitch.

With cameras 104 being synced, computing device 110 may analyze the various video streams to determine whether a pitch was a ball or a strike, if computing device 110 determines that the batter did not swing the bat. In instances where the batter swung the bat, other analysis may be utilized to determine whether the pitch was a strike or some other play (e.g., a foul ball, an out, or an in-play hit to reset the batter's count). Cameras 104 may be synced with timestamps, in some instances, where the timestamps in and of themselves are also synced. In instances where only a single camera is used to create the virtual strike zone, the techniques described herein may tolerate milliseconds of being out of sync, utilizing instead a catcher's motion in catching the pitch and/or a digital timer in the field of view of the single camera.

For instance, computing device 110 may analyze a stream from one of cameras 104B and 104C to determine a time that the ball passed through by a plane that includes the virtual strike zone. Computing device 110 may then cross-reference that analysis with an analysis of a video stream from camera 104A to determine where in that plane that includes the virtual strike zone the ball was at that time. If computing device 110 determines that the ball was inside the virtual strike zone at the time the ball passed through by a plane that includes the virtual strike zone, computing device 110 may determine that the ball was a strike. For the purposes of this disclosure, a ball may be considered to have been inside the virtual strike zone if the ball was partially or completely within the strike zone at the time the ball passed through the plane that includes the virtual strike zone. If computing device 110 determines that the ball was outside of the virtual strike zone at the time the ball passed through by a plane that includes the virtual strike zone, computing device 110 may determine that the ball was a ball.

In other instances, computing device 110 may identify at least a first frame from one of the video streams where the ball has not yet passed over the common focal point and identify at least a second frame where the ball has already passed over the common focal point. Computing device 110 may then predict the physical point where the ball passed over the common focal point based at least in part on a position of the ball in the first frame and a position of the ball in the second frame, such as by connecting those positions and determining whether the connection intersects with the virtual strike zone. In some instances, computing device 110 may further determine one or more of a speed of the ball, a trajectory of the ball, a spin rate of the ball, and a rotation direction of the ball, and further use those characteristics of the pitch in making that connection between positions in the first and second frames to determine whether the connection passes through the virtual strike zone.

In other instances of predicting the physical point where the ball passed over the common focal point, computing device 110 may identify a first frame where the ball is closest to being over the common focal point. In such instances, computing device 110 may predict the physical point where the ball passed over the common focal point based at least in part on a position of the ball in the first frame.

Figure 2:
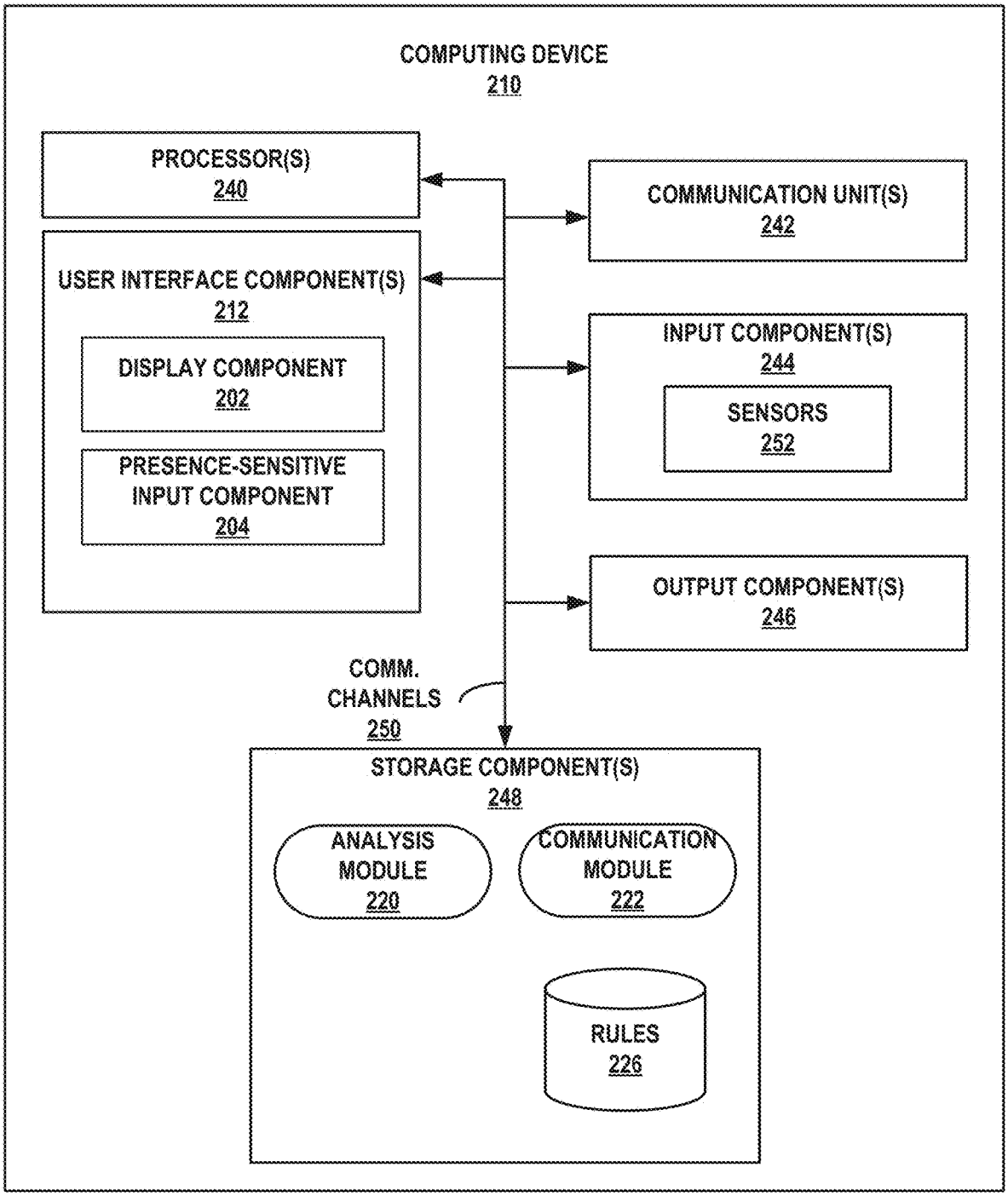
FIG. 2 is a block diagram illustrating a more detailed example of a computing device configured to perform the techniques described herein.

FIG. 2 is a block diagram illustrating a more detailed example of a computing device configured to perform the techniques described herein. Computing device 210 of FIG. 2 is described below as an example of computing device 110 of FIG. 1. FIG. 2 illustrates only one particular example of computing device 210, and many other examples of computing device 210 may be used in other instances and may include a subset of the components included in example computing device 210 or may include additional components not shown in FIG. 2.

Computing device 210 may be any computer with the processing power required to adequately execute the techniques described herein. For instance, computing device 210 may be any one or more of a mobile computing device (e.g., a smartphone, a tablet computer, a laptop computer, etc.), a desktop computer, a smarthome component (e.g., a computerized appliance, a home security system, a control panel for home components, a lighting system, a smart power outlet, etc.), a wearable computing device (e.g., a smart watch, computerized glasses, a heart monitor, a glucose monitor, smart headphones, etc.), a virtual reality/augmented reality/extended reality (VR/AR/XR) system, a video game or streaming system, a network modem, router, or server system, or any other computerized device that may be configured to perform the techniques described herein.

As shown in the example of FIG. 2, computing device 210 includes user interface components (UIC) 212, one or more processors 240, one or more communication units 242, one or more input components 244, one or more output components 246, and one or more storage components 248. UIC 212 includes display component 202 and presence-sensitive input component 204. Storage components 248 of computing device 210 include analysis module 220, communication module 222, and rules data store 226.

One or more processors 240 may implement functionality and/or execute instructions associated with computing device 210 to create a virtual strike zone and automatically umpire a sports game. That is, processors 240 may implement functionality and/or execute instructions associated with computing device 210 to create a virtual strike zone and automatically umpire a sports game.

Examples of processors 240 include any combination of application processors, display controllers, auxiliary processors, one or more sensor hubs, and any other hardware configured to function as a processor, a processing unit, or a processing device, including dedicated graphical processing units (GPUs). Modules 220 and 222 may be operable by processors 240 to perform various actions, operations, or functions of computing device 210. For example, processors 240 of computing device 210 may retrieve and execute instructions stored by storage components 248 that cause processors 240 to perform the operations described with respect to modules 220 and 222. The instructions, when executed by processors 240, may cause computing device 210 to create a virtual strike zone and automatically umpire a sports game.

Analysis module 220 may execute locally (e.g., at processors 240) to provide functions associated with video analysis on any video data received from any cameras, including determining a virtual strike zone and automatically umpiring a game. In some examples, analysis module 220 may act as an interface to a remote service accessible to computing device 210. For example, UI module 220 may be an interface or application programming interface (API) to a remote server that performs video analysis on any video data received from any cameras, including determining a virtual strike zone and automatically umpiring a game.

In some examples, communication module 222 may execute locally (e.g., at processors 240) to provide functions associated with communicating with cameras to receive video data and user devices to output game results. In some examples, communication module 222 may act as an interface to a remote service accessible to computing device 210. For example, communication module 222 may each be an interface or application programming interface (API) to a remote server that communicates with cameras to receive video data and user devices to output game results.

One or more storage components 248 within computing device 210 may store information for processing during operation of computing device 210 (e.g., computing device 210 may store data accessed by modules 220 and 222 during execution at computing device 210). In some examples, storage component 248 is a temporary memory, meaning that a primary purpose of storage component 248 is not long-term storage. Storage components 248 on computing device 210 may be configured for short-term storage of information as volatile memory and therefore not retain stored contents if powered off. Examples of volatile memories include random access memories (RAM), dynamic random access memories (DRAM), static random access memories (SRAM), and other forms of volatile memories known in the art.

Storage components 248, in some examples, also include one or more computer-readable storage media. Storage components 248 in some examples include one or more non-transitory computer-readable storage mediums. Storage components 248 may be configured to store larger amounts of information than typically stored by volatile memory. Storage components 248 may further be configured for long-term storage of information as non-volatile memory space and retain information after power on/off cycles. Examples of non-volatile memories include magnetic hard discs, optical discs, floppy discs, flash memories, or forms of electrically programmable memories (EPROM) or electrically erasable and programmable (EEPROM) memories. Storage components 248 may store program instructions and/or information (e.g., data) associated with modules 220 and 222 and data store 226. Storage components 248 may include a memory configured to store data or other information associated with modules 220 and 222 and data store 226.

Communication channels 250 may interconnect each of the components 212, 240, 242, 244, 246, and 248 for inter-component communications (physically, communicatively, and/or operatively). In some examples, communication channels 250 may include a system bus, a network connection, an inter-process communication data structure, or any other method for communicating data.

One or more communication units 242 of computing device 210 may communicate with external devices via one or more wired and/or wireless networks by transmitting and/or receiving network signals on one or more networks. Examples of communication units 242 include a network interface card (e.g., such as an Ethernet card), an optical transceiver, a radio frequency transceiver, a GPS receiver, a radio-frequency identification (RFID) transceiver, a near-field communication (NFC) transceiver, or any other type of device that can send and/or receive information. Other examples of communication units 242 may include short wave radios, cellular data radios, wireless network radios, as well as universal serial bus (USB) controllers.

One or more input components 244 of computing device 210 may receive input. Examples of input are tactile, audio, and video input. Input components 244 of computing device 210, in one example, include a presence-sensitive input device (e.g., a touch sensitive screen, a PSD), mouse, keyboard, voice responsive system, camera, microphone or any other type of device for detecting input from a human or machine. In some examples, input components 244 may include one or more sensor components (e.g., sensors 252). Sensors 252 may include one or more biometric sensors (e.g., fingerprint sensors, retina scanners, vocal input sensors/microphones, facial recognition sensors, cameras), one or more location sensors (e.g., GPS components, Wi-Fi components, cellular components), one or more temperature sensors, one or more movement sensors (e.g., accelerometers, gyros), one or more pressure sensors (e.g., barometer), one or more ambient light sensors, and one or more other sensors (e.g., infrared proximity sensor, hygrometer sensor, and the like). Other sensors, to name a few other non-limiting examples, may include a radar sensor, a lidar sensor, a sonar sensor, a heart rate sensor, magnetometer, glucose sensor, olfactory sensor, compass sensor, or a step counter sensor.

One or more output components 246 of computing device 210 may generate output in a selected modality. Examples of modalities may include a tactile notification, audible notification, visual notification, machine generated voice notification, or other modalities. Output components 246 of computing device 210, in one example, include a presence-sensitive display, a sound card, a video graphics adapter card, a speaker, a cathode ray tube (CRT) monitor, a liquid crystal display (LCD), a light emitting diode (LED) display, an organic LED (OLED) display, a virtual/augmented/extended reality (VR/AR/XR) system, a three-dimensional display, or any other type of device for generating output to a human or machine in a selected modality.

UIC 212 of computing device 210 may include display component 202 and presence-sensitive input component 204. Display component 202 may be a screen, such as any of the displays or systems described with respect to output components 246, at which information (e.g., a visual indication) is displayed by UIC 212 while presence-sensitive input component 204 may detect an object at and/or near display component 202.

While illustrated as an internal component of computing device 210, UIC 212 may also represent an external component that shares a data path with computing device 210 for transmitting and/or receiving input and output. For instance, in one example, UIC 212 represents a built-in component of computing device 210 located within and physically connected to the external packaging of computing device 210 (e.g., a screen on a mobile phone). In another example, UIC 212 represents an external component of computing device 210 located outside and physically separated from the packaging or housing of computing device 210 (e.g., a monitor, a projector, etc. that shares a wired and/or wireless data path with computing device 210).

UIC 212 of computing device 210 may detect two-dimensional and/or three-dimensional gestures as input from a user of computing device 210. For instance, a sensor of UIC 212 may detect a user's movement (e.g., moving a hand, an arm, a pen, a stylus, a tactile object, etc.) within a threshold distance of the sensor of UIC 212. UIC 212 may determine a two or three-dimensional vector representation of the movement and correlate the vector representation to a gesture input (e.g., a hand-wave, a pinch, a clap, a pen stroke, etc.) that has multiple dimensions. In other words, UIC 212 can detect a multi-dimension gesture without requiring the user to gesture at or near a screen or surface at which UIC 212 outputs information for display. Instead, UIC 212 can detect a multi-dimensional gesture performed at or near a sensor which may or may not be located near the screen or surface at which UIC 212 outputs information for display.

In accordance with the techniques described herein, one or more cameras are installed on a sports field, including at least a first camera. The first camera is installed at a first location, and a second camera, when installed, may be installed at a second location different than the first location. Each of the plurality of cameras may be directed at a common focal point, meaning that each of the cameras may be positioned such that the common focal point is captured in a video stream produced by the respective camera. In some instances, the first location is a location approximately even with (e.g., within 5-10 degrees of being perpendicular with the common focal point and a mound of the sports field) the common focal point on one of a first base side of the common focal point or a third base side of the common focal point, and the second location is a location in an outfield of the sports field. In some examples, a third camera is placed at the one of the first base side and the third base side that is not the first location (i.e., a camera is ultimately placed at each of the first base side of the common focal point and the third base side of the common focal point). In instances where only a single camera is utilized, the first location may be a center field location. In some examples, an additional camera is located at a location approximately behind the common focal point. In some examples, additional cameras (e.g., upwards of five or more cameras) may be placed throughout the field. The common focal point is typically a home plate on the sports field, although other common focal points may be used (e.g., a pitcher's mound, a catcher, a location between the pitcher's mound and home plate, a batter's box, etc.). Each of the plurality of cameras may capture individual video streams, which are transmitted to computing device 210 where the individual video streams are received by communication unit 222.

Analysis module 220 may detect a batter near the common focal point in each of the individual video streams and construct a virtual strike zone above the common focal point and in front of the batter based at least in part on each of the individual video streams and one or more of one or more stance characteristics of the batter and one or more physical characteristics of the batter. For instance, the one or more physical characteristics of the batter may be one or more of a height of the batter and a knee-to-chest measurement for the batter. Additionally or alternatively, the one or more stance characteristics of the batter may be any one or more of a knee height of the batter when the batter is in a batting stance, a hip height of the batter when the batter is in the batting stance, a shoulder height of the batter when the batter is in the batting stance, a chest height of the batter when the batter is in the batting stance, a stance width of the batter when the batter is in the batting stance, and a body height of the batter when the batter is in the batting stance, among other things.

In some instances, the stance and/or physical characteristics of the batter may be determined using a virtual bounding box. In such instances, analysis module 220 may, in the video stream, draw a bounding box around the batter prior to a pitch being thrown, such as with a camera installed at a center field location. Analysis module 220 may regress a default location of a strike zone for an average batter or among many batters to a new location based on a height percentage of the bounding box as compared to the average batter. For instance, if analysis module 220 draws a bounding box 95% as high as a typical bounding box, analysis module 220 may reduce the height of the strike zone and shift the strike zone accordingly.

In some instances, analysis module 220 may further detect a pitching motion performed by a pitcher within one or more of the individual video streams. Analysis module 220 may identify a ball leaving a hand of the pitcher within one or more of the individual video streams and, in response to identifying the ball, track the ball within one or more of the individual video streams as the ball travels towards the common focal point. Analysis module 220 may then, at least in instances where no swing is detected by the batter, predict, based on the tracking of the ball, a physical point where the ball passed over the common focal point and determine whether the physical point where the ball passed over the common focal point is within, partially or completely, the virtual strike zone. In response to determining that the physical point where the ball passed over the common focal point is within the virtual strike zone, analysis module 220 may determine the pitch was a strike and communication module 222 may send, to a user device, an indication of a strike call. In some instances of the alternative, in response to determining that the physical point where the ball passed over the common focal point is not within the virtual strike zone, analysis module 220 may determine the pitch was a ball and communication module 222 may send, to a user device, an indication of a ball call. In other instances of the alternative, in response to determining that the physical point where the ball passed over the common focal point is not within the virtual strike zone, analysis module 220 may determine that the pitch was simply not a strike, and communication module 222 may refrain from sending any indications to the user device. In these instances, an official at the site would not receive the indication of the strike call at their user device, and could then assume the pitch was a ball. The user device may be any one or more of a handheld computing device or a scoreboard display system, and the indication of the strike or the indication of the ball may be one or more of an audio alert or a visual alert.

In still other instances, analysis module 220 may be unable to predict whether a pitch was a ball or a strike due to issues such as low bandwidth, obstructions, or algorithm failure. As such, communication module 222 may send additional indications to a user device indicating whether computing device 210 and analysis module 220 was able to perform a full analysis on the pitch. For instance, when analysis module 220 successfully performed the full analysis on the pitch, communication module 222 may send both an indication that a call was able to be made and what the result of the call was. Conversely, when analysis module 220 was unable to perform the full analysis on the pitch, communication module 222 may send an indication that the call was unable to be made so that a user on the field can make a call independent on the system.

In some instances of predicting the physical point where the ball passed over the common focal point, analysis module 220 may identify at least a first frame where the ball has not yet passed over the common focal point and identify at least a second frame where the ball has already passed over the common focal point. Analysis module 220 may then predict the physical point where the ball passed over the common focal point based at least in part on a position of the ball in the first frame and a position of the ball in the second frame, such as by connecting those positions and determining whether the connection intersects with the virtual strike zone. In some instances, analysis module 220 may further determine one or more of a speed of the ball, a trajectory of the ball, a spin rate of the ball, and a rotation direction of the ball, and further use those characteristics of the pitch in making that connection between positions in the first and second frames to determine whether the connection passes through the virtual strike zone.

In other instances of predicting the physical point where the ball passed over the common focal point, analysis module 220 may identify a first frame where the ball is closest to being over the common focal point. In such instances, analysis module 220 may predict the physical point where the ball passed over the common focal point based at least in part on a position of the ball in the first frame.

In still other instances of predicting the physical point where the ball passed over the common focal point, analysis module 220 may determine, based on the video stream captured by the first camera (e.g., a first base side or third base side camera), a time which the ball crossed a plane that includes the virtual strike zone. Analysis module 220 may then determine a location of the ball in the video stream captured by the second camera at the time which the ball crossed the plane that includes the virtual strike zone. Analysis module 220 may determine whether the location of the ball in the video stream captured by the second camera at the time which the ball crossed the plane that includes the virtual strike zone is inside the virtual strike zone or outside the virtual strike zone. In response to determining that the location is inside the virtual strike zone, analysis module 220 may determine that the pitch is a strike. In response to determining that the location is outside the virtual strike zone, analysis module 220 may determine that the pitch is a ball.

In some examples, communication module 222 may further receive, from the user device, and in response to sending the indication of the ball or the indication of the strike to the user device, a confirmation of the received indication or a reversal of the received indication. Analysis module 220 may adjust rules data store 226 based on the confirmation or reversal received by communication module 222 in order to update any models or virtual strike zone characteristics used in the automatic umpiring process for future pitches.

In some examples, analysis module 220 may adjust the virtual strike zone based on one or more game circumstances, such as by making the virtual strike zone generally larger or generally smaller. Game circumstances that analysis module 220 may consider in adjusting the virtual strike zone may include any one or more of an age of one or more participants (e.g., larger strike zones with younger individuals), a skill level of one or more participants (e.g., larger strike zones with less skilled participants), a current game score (e.g., a larger strike zone when a run differential in the game is larger than a threshold, such as 10, 12, or 15 runs), a height of one or more participants (e.g., larger strike zones for smaller individuals), and a user preference (e.g., individuals may prefer larger or smaller strike zones for different leagues). Analysis module 220 may determine the one or more game circumstances based on one or more of received user input (e.g., users may input any of the game circumstances into the system) and image analysis of one or more of the individual video streams (e.g., analysis of the participants, ball-strike ratios throughout the game, and scoreboard analysis). Analysis module 220 may adjust the virtual strike zone by either shrinking the virtual strike zone or expanding the virtual strike zone by a particular percentage or a particular measurement (e.g., a certain number of centimeters or inches).

In some examples, analysis module 220 may further determine a degree offset for each of one or more of the plurality of cameras. The degree offset may be a number of degrees away from 90 degrees the respective camera makes when pointed at the common focal point. For instance, in an ideal scenario, a first camera on either a first or third base side of home plate may be pointed at home plate and the outfield camera may also be pointed at home plate. Lines extending from these cameras would meet at home plate and create a 90 degree angle. However, those ideal scenarios may not always be possible. In one example, a structure in center field may force an outfield camera to be offset from a line that would create a 90 degree angle with a pitcher's mound and home plate when drawn from the outfield camera to home plate. The number of degrees offset from 90 may be accounted for when drawing the strike zone from the center field camera. In order to account for variations, analysis module 220 may determine the degree offsets for the cameras, and may adjust the analysis performed on the video streams based on the offsets for the cameras to create an adequate virtual strike zone.

In some instances, analysis module 220 may detect a swing by the batter in one or more of the individual video streams through the video or image analysis. In such instances, analysis module 220 may further track, based at least in part on one or more of the individual video streams, the ball after the swing to determine a post-swing ball path and determine, based at least in part on the post-swing ball path, a play outcome after the swing by the batter. For instance, the play outcome may be any one or more of a foul ball (i.e., the post-swing ball path was a path of a foul ball), a caught foul ball (i.e., the post-swing ball path ended in a glove of a defender in foul territory), a caught fair ball (i.e., the post-swing ball path ended in a glove of a defender in fair territory), an in-play fair ball (i.e., the post-swing ball path ended with the ball landing on the ground in fair territory), a swing-and-miss (i.e., the post-swing ball path ended in a glove of the catcher without the bat contacting the ball and the batter completely swung the bat), and a check swing (i.e., the post-swing ball path ended in a glove of the catcher without the bat contacting the ball and the batter did not completely swing the bat). In these instances, more cameras may be implemented on the sports field that are not directed at the common focal point in order to better determine the outcome of the play.

In some instances, the cameras may be stereoscopic. For instance, the first location may be a point on either a first base side of the common focal point or a third base side of the common focal point, and the second location is a first, fixed distance away from the first location such that a first video stream captured by the first camera and a second video stream captured by the second camera create a series of stereoscopic images that perceive depth. In some such instances, analysis module 220 may identify a timestamp in the first video stream at which the ball reaches a particular location over the common focal point and identify a timestamp in the second video stream at which the ball reaches the particular location over the common focal point. Analysis module 220 may then determine a timestamp difference, the timestamp difference being a difference between the timestamp in the first video stream and the timestamp in the second video stream. Analysis module 220 may use the timestamp difference and the particular location in comparison to the virtual strike zone to determine whether the ball was thrown to be a strike or a ball. In some instances, analysis module 220 may further determining whether the ball was thrown to be the strike or the ball based additionally on one or more of a speed of the ball, a trajectory of the ball, a spin rate of the ball, and a rotation direction of the ball.

In other such instances, analysis module 220 may utilize the series of stereoscopic images to calculate the position of the ball in three-dimensional space is it travels from the pitcher's mound to home plate. Analysis module 220 may determine the closest timestamps at which the ball is detected in both camera views and in the stereoscopic images and calculate the position of the ball in three-dimensional space around those times. Using the trajectory of the ball and the positions of the ball in those stereoscopic images, analysis module 220 may determine a point of intersection with the strike zone to assist in determining whether the pitch was a ball or a strike.

Computing device 110 may employ any of a number of video analysis techniques that utilize artificial intelligence models or matured models (i.e., models that have already been trained to the fullest intended capacity) to locate objects in a video stream and identify those objects, such as by determining that an object has a certain percentage chance of being a particular type of object (e.g., a person, a base, a plate, a sports ball, a bat, etc.) based on the analysis.

Computing device 110 may utilize such a video analysis technique to identify the object that has a highest percentage chance of being home plate. After identifying home plate, computing device 110 may identify a person standing nearby home plate as the batter. Computing device 110 may then determine one or more stance characteristics of the batter (e.g., a knee height of the batter when the batter is in a batting stance, a hip height of the batter when the batter is in the batting stance, a shoulder height of the batter when the batter is in the batting stance, a chest height of the batter when the batter is in the batting stance, a stance width of the batter when the batter is in the batting stance, a body height of the batter when the batter is in the batting stance etc.) or one or more physical characteristics of the batter (e.g., a height of the batter, a knee-to-chest measurement for the batter, etc.). Computing device 110 may determine these characteristics either based on information uploaded to the system or based on the video analysis performed on the video.

With this information, computing device 110 may generate a virtual strike zone, either two-dimensionally as a limited plane or a three-dimensional graphic, above the object identified as home plate and in front of the object identified as the batter based on general rules of the league for which the automatic umpiring system is implemented (e.g., bottom of the knees up to the midpoint between the shoulders and the waistline, top of the knees to the armpits, waistline to the shoulders, etc.). Computing device 110 may also adjust the strike zone to be larger or smaller depending on skill levels of the players (e.g., youth league, high school, college, professional minor leagues, professional major leagues, etc.) and game situation (e.g., expanding or shrinking the strike zone in a blowout, expanding the strike zone when the game time is abnormally long, etc.).

Computing device 110 may also identify a pitcher and a sports ball in the video data. As computing device 110 identifies that a pitcher is making a pitching motion to throw a sports ball towards home plate, computing device 110 may identify the sports ball within the video frames. Computing device 110 may track the sports ball as it travels through the air, identifying whether the pitch was a strike or a ball at least in instances where computing device 110 determines that the batter did not swing a bat. In some instances, computing device 110 may have a video frame that includes an exact moment the sports ball crosses the virtual strike zone. In other instances, such as instances where potentially a camera quality is lower and cannot capture a high enough frames-per-second framerate, computing device 110 may instead determine a location of the sports ball in one or more frames before the sports ball crosses the virtual strike zone and a location of the sports ball in one or more frames after the sports ball crosses the virtual strike zone. Based at least on these identified frames, and potentially further based on a speed of the pitch and a spin rate and spin direction of the sports ball, computing device 110 may construct a virtual flight path of the sports ball throughout at least this portion of the pitch. Based on this virtual flight path and whether the virtual flight path intersects with the virtual strike zone, computing device 110 may determine whether the pitch was a strike or a ball.

Computing device 110 may perform additional video analysis on the video received from the various cameras. For instance, computing device 110 may determine a play result. Computing device 110 may determine that the batter attempted to swing the bat through the video analysis. To determine whether the swing was completed or checked, computing device 110 may determine one or more of whether the bat crossed a particular point over home plate or the bat position relative to the batter. Computing device 110 may then track the sports ball. If computing device 110 determines that the batter completely swung the bat and did not make contact with the ball, computing device 110 may determine the play result as a swinging strike. If computing device 110 determines that the batter completely swung the bat and did make contact with the ball, computing device 110 may continue tracking the ball in the video data to determine a spot where the ball lands to determine whether the play result is an in-play ball, a foul ball, or a pop out, among other possible plays. If computing device 110 determines that the batter check swung at the ball, computing device 110 may use the strike determination process above to determine whether the pitch was a strike or a ball. Computing device 110 may also analyze the video to determine if other plays occur, such as a throw home without a pitch due to a player attempting to steal home, a batter not swinging but the ball hitting the bat, or the ball hitting the batter.

In some instances, each of these determinations from computing device 110 can be obtained through video analysis of multiple streams from different cameras at different angles. For instance, computing device 110 may take video streams from two or more known locations (e.g., an outfield location and a first or third base side of home plate) and combine the analysis from multiple video streams to create the virtual strike zone or any of the determinations. By using the multiple angles, the probabilities determined for identifying the various objects and characteristics of those objects may be increased in order to develop more reliable results and locations of objects in the playing field. This may also assist computing device 110 in analyzing blind spots created by players or other objects blocking certain objects in the view of one of the video streams, such as a left-handed batter blocking home plate in a first-base side camera stream.

Figure 3:
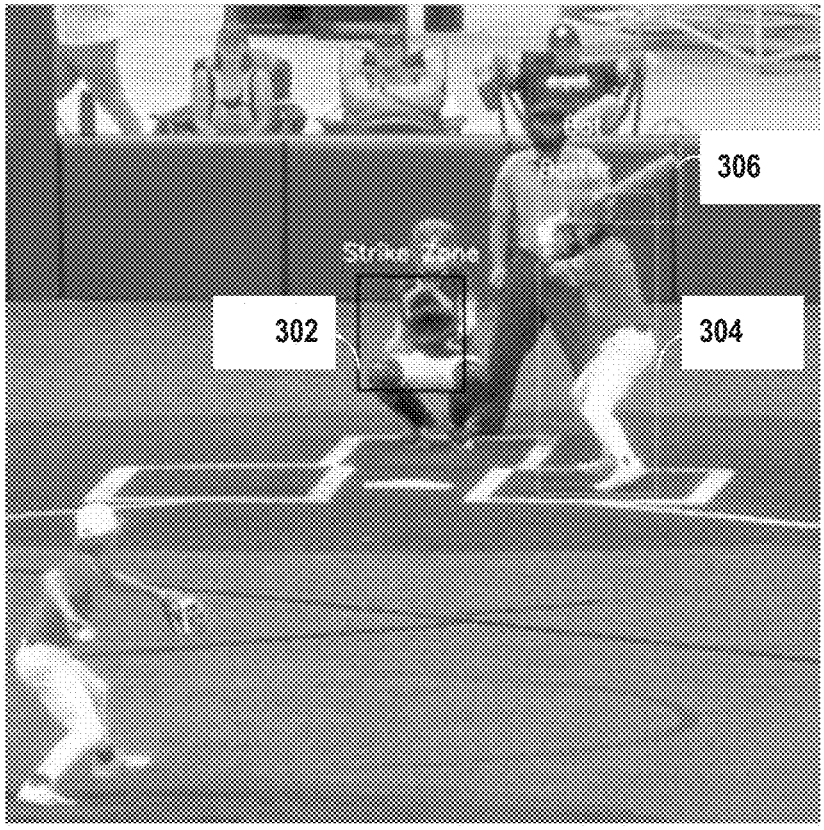
FIG. 3 is an example frame of a video stream illustrating a graphical representation of a virtual strike zone automatically identified by a computing device in accordance with one or more techniques described herein.

FIG. 3 is an example frame of a video stream including a graphical representation of a virtual strike zone 302 automatically identified by a computing device in accordance with one or more techniques described herein. Such a frame could be from a video captured by camera 104A located in an outfield of sports field 102 and transmitted to computing device 110 for analysis. Computing device 110 may determine any one or more of a pitcher-side shoulder location, a pitcher-side hip location, a pitcher-side knee location, a backstop-side shoulder location, a backstop-side hip location, and a backstop-side knee location for the hitter seen in the video received from camera 104. From any subset of these points, computing device 110 may construct a batter 304-specific virtual strike zone 302 within the video stream received from camera 104A, transposing that virtual strike zone 302 over the determined home plate in order to call a baseball or softball game. Computing device 110 may also detect batter 304 and bat 306 in the video stream.

When a ball is determined to have passed home plate 106 by one or more of cameras 104B and 104C, a particular frame along with a timestamp can be identified from the respective video stream from one or more of cameras 104B and 104C. Computing device 110 may retrieve a same- or similar-timestamped frame from the video stream of camera 104A and determine whether the ball is within the virtual strike zone at that time, enabling computing device to call balls and strikes in a baseball or softball game accordingly.

Figure 4:
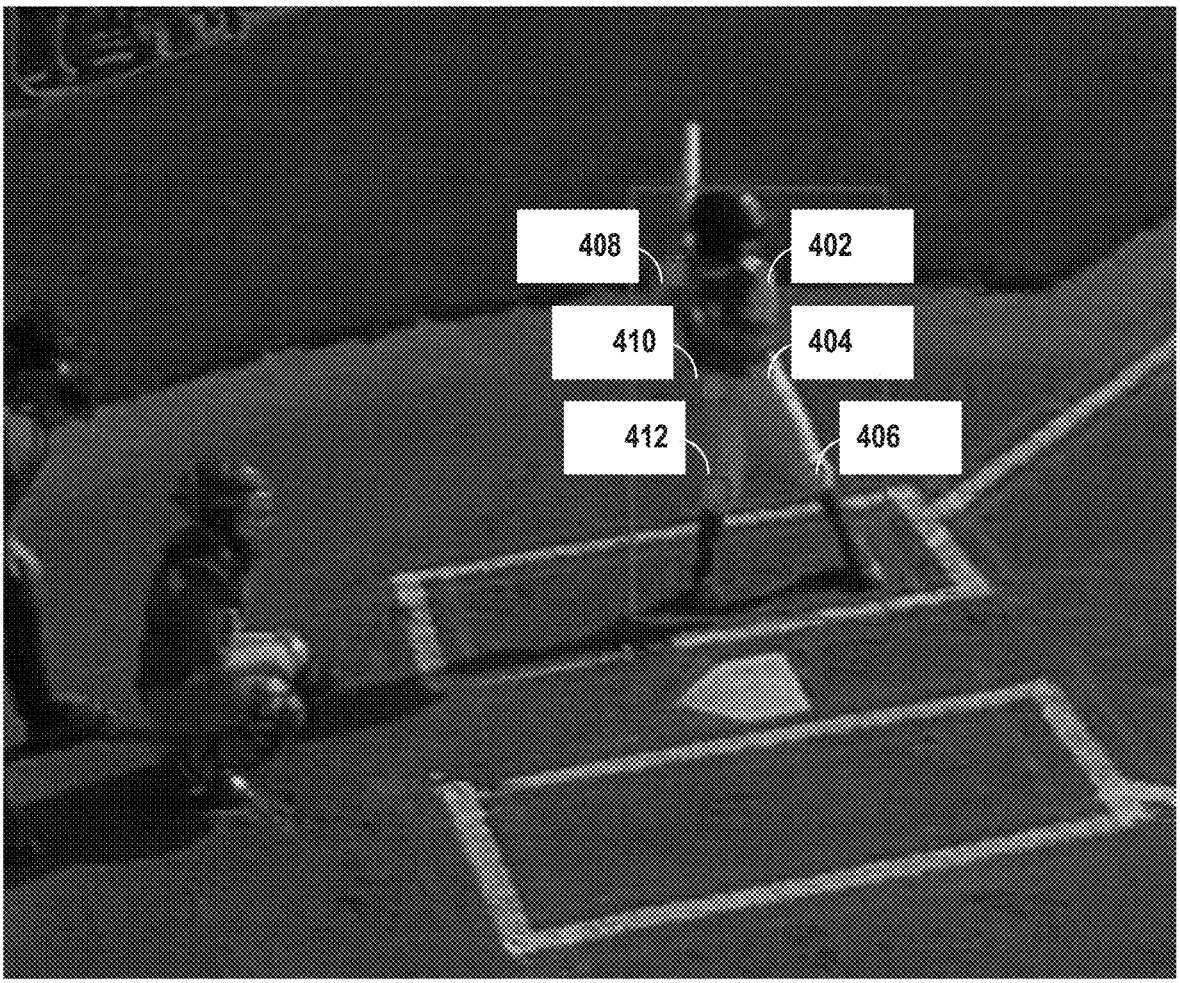
FIG. 4 is an example frame of a video stream illustrating physical characteristics of a batter used to construct a virtual strike zone, in accordance with one or more techniques described herein.
Figure 5:
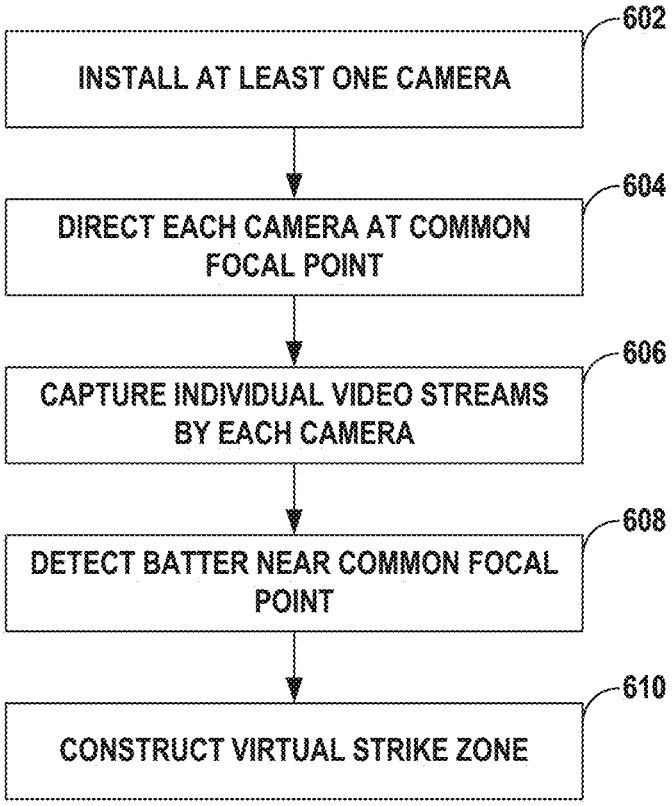
FIG. 5 is a flow chart illustrating a method for arranging one or more cameras on a sports field and using the resulting video streams to construct a virtual strike zone, in accordance with one or more techniques described herein.

FIG. 4 is an example frame of a video stream illustrating physical characteristics of a batter used to construct a virtual strike zone, in accordance with one or more techniques described herein. The frame shown in FIG. 4 may be captured by a camera located at a sports field, such as camera 104B on a first base side of home plate. Camera 104B may transmit video data, including this frame of video, to a computing device, such as computing device 110, for analysis. However, in other examples, poses may be determined from other cameras for the purpose of drawing a virtual strike zone. For instance, rather than camera 104B, camera 104A located in the outfield of the sports field may be used to detect the points on the batter's body and determine pose characteristics of the batter in order to draw the virtual strike zone as described herein.

With this frame, computing device 110 may identify the batter and certain points on the batter's body in an effort to create a virtual strike zone. For instance, computing device 110 may determine any one or more of a pitcher-side shoulder location 402, a pitcher-side hip location 404, a pitcher-side knee location 406, a backstop-side shoulder location 408, a backstop-side hip location 410, and a backstop-side knee location 412. From any subset of these points, computing device 110 may construct a batter-specific virtual strike zone, transposing that virtual strike zone over the determined home plate in order to call a baseball or softball game in accordance with the techniques described throughout this disclosure.

FIG. 6 is a flow chart illustrating an example mode of operation. The techniques of FIG. 6 may be performed by one or more processors of a computing device, such as system 100 of FIG. 1 and/or computing device 210 illustrated in FIG. 2. For purposes of illustration only, the techniques of FIG. 6 are described within the context of system 100 of FIG. 1, although computing devices having configurations different than that of computing device 100 may perform the techniques of FIG. 6.

In accordance with the techniques described herein, a user or a system may install, on sports field 102, a plurality of cameras including at least first camera 104A, and possibly second camera 104B (602). The first camera is installed at a first location (e.g., an outfield location approximately in front of focal point 106), and the second camera, if installed, is installed at a second location different than the first location (e.g., to one of a first base side or a third base side of focal point 106). The user or system directs each of the installed cameras at focal point 106 (604). Each of the cameras captures an individual video stream (606). Computing device 110 detects a batter near focal point 106 in each of the individual video streams (608). Computing device 110 constructs a virtual strike zone above the common focal point and in front of the batter based at least in part on each of the individual video streams and one or more of one or more stance characteristics of the batter and one or more physical characteristics of the batter (610).

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various examples of the disclosure have been described. Any combination of the described systems, operations, or functions is contemplated. These and other examples are within the scope of the following claims.

What is claimed is:

1. A method comprising:

installing, on a sports field, one or more cameras including at least a first camera, wherein the first camera is installed at a first location;

directing each of the one or more cameras at a common focal point;

capturing an individual video stream by each of the one or more cameras;

detecting, by one or more processors, a batter near the common focal point in each of the individual video streams;

constructing, by the one or more processors, a virtual strike zone above the common focal point and in front of the batter based at least in part on each of the individual video streams and one or more of one or more stance characteristics of the batter and one or more physical characteristics of the batter;

detecting, by the one or more processors, a pitching motion performed by a pitcher within one or more of the individual video streams;

identifying, by the one or more processors, a ball leaving a hand of the pitcher within one or more of the individual video streams;

in response to identifying the ball, tracking, by the one or more processors, the ball within one or more of the individual video streams as the ball travels towards the common focal point;

predicting, by the one or more processors, and based on the tracking of the ball, a physical point where the ball passed over the common focal point;

determining, by the one or more processors, whether the physical point where the ball passed over the common focal point is within the virtual strike zone;

in response to determining that the physical point where the ball passed over the common focal point is within the virtual strike zone, sending, by the one or more processors, and to a user device, an indication of a strike call; and receiving, by the one or more processors, from the user device, and in response to sending the indication of the ball or the indication of the strike to the user device, a confirmation of the received indication or a reversal of the received indication.

2. The method of claim 1, further comprising:

in response to determining that the physical point where the ball passed over the common focal point is not within the virtual strike zone either:

sending, by the one or more processors, and to a user device, an indication of a ball call; or refraining, by the one or more processors, from sending the indication of the strike call to the user device.

3. The method of claim 1, further comprising:

sending, by the one or more processors, a success indication to the user device, the success indication indicating whether the one or more processors were able to fully analyze the ball during a pitch to determine a strike call or a ball call.

4. The method of claim 1, wherein predicting the physical point where the ball passed over the common focal point comprises:

identifying, by the one or more processors, at least a first frame where the ball has not yet passed over the common focal point;

identifying, by the one or more processors, at least a second frame where the ball has already passed over the common focal point; and predicting, by the one or more processors, the physical point where the ball passed over the common focal point based at least in part on a position of the ball in at least the first frame and a position of the ball in at least the second frame.

5. The method of claim 4, wherein predicting the physical point where the ball passed over the common focal point is further based on one or more of a speed of the ball, a trajectory of the ball, a spin rate of the ball, and a rotation direction of the ball.

6. The method of claim 1, wherein predicting the physical point where the ball passed over the common focal point comprises:

identifying, by the one or more processors, a first frame where the ball is closest to being over the common focal point; and predicting, by the one or more processors, the physical point where the ball passed over the common focal point based at least in part on a position of the ball in the first frame.

7. The method of claim 1, wherein the user device comprises one or more of a handheld computing device or a scoreboard display system, and wherein the indication of the strike or the indication of the ball comprise one or more of an audio alert or a visual alert.

8. The method of claim 1, further comprising:

adjusting, by the one or more processors, the virtual strike zone based on one or more game circumstances, wherein the one or more game circumstances comprise one or more of:

an age of one or more participants;

a skill level of one or more participants;

a current game score;

a height of one or more participants; and a user preference.

9. The method of claim 8, further comprising:

determining, by the one or more processors, the one or more game circumstances based on one or more of received user input and image analysis of one or more of the individual video streams.

10. The method of claim 8, wherein adjusting the virtual strike zone comprises either shrinking the virtual strike zone or expanding the virtual strike zone by a particular percentage or a particular measurement.

11. The method of claim 1, wherein the one or more physical characteristics of the batter comprise one or more of a height of the batter and a knee-to-chest measurement for the batter, and wherein the one or more stance characteristics of the batter comprise one or more of a knee height of the batter when the batter is in a batting stance, a hip height of the batter when the batter is in the batting stance, a shoulder height of the batter when the batter is in the batting stance, a chest height of the batter when the batter is in the batting stance, a stance width of the batter when the batter is in the batting stance, and a body height of the batter when the batter is in the batting stance.

12. The method of claim 1, further comprising determining the one or more stance characteristics of the batter and the one or more physical characteristics of the batter by:

detecting, by the one or more processors and in at least a first individual video stream, the batter;

drawing, by the one or more processors, a bounding box around the batter while the batter is in a hitting stance; and comparing, by the one or more processors, the bounding box to an average bounding box.

13. The method of claim 1, further comprising:

detecting, by the one or more processors, a swing by the batter in one or more of the individual video streams.

14. The method of claim 13, further comprising:

tracking, by the one or more processors and based at least in part on one or more of the individual video streams, the ball after the swing to determine a post-swing ball path; and determining, by the one or more processors and based at least in part on the post-swing ball path, a play outcome after the swing by the batter.

15. The method of claim 14, wherein the play outcome comprises one or more of a foul ball, a caught foul ball, a caught fair ball, an in-play fair ball, a swing-and-miss, and a check swing.

16. The method of claim 1, wherein the common focal point comprises a home plate on the sports field.

17. The method of claim 1, wherein the one or more cameras includes a second camera installed at a second location different than the first location.

18. The method of claim 17, wherein the first location comprises a point on either a first base side of the common focal point or a third base side of the common focal point, and wherein the second location is a first distance away from the first location such that a first video stream captured by the first camera and a second video stream captured by the second camera create a series of stereoscopic images.

19. The method of claim 18, further comprising:

identifying, by the one or more processors, a timestamp in the first video stream at which the ball reaches a particular location over the common focal point;

identifying, by the one or more processors, a timestamp in the second video stream at which the ball reaches the particular location over the common focal point;

determining, by the one or more processors, a timestamp difference, the timestamp difference being a difference between the timestamp in the first video stream and the timestamp in the second video stream; and determining, by the one or more processors and based on the timestamp difference and the particular location in comparison to the virtual strike zone, whether the ball was thrown to be a strike or a ball.

20. The method of claim 19, wherein determining whether the ball was thrown to be the strike or the ball is further based on one or more of a speed of the ball, a trajectory of the ball, a spin rate of the ball, and a rotation direction of the ball.

21. The method of claim 17, wherein the first location comprises a location approximately even with the common focal point on one of a first base side of the common focal point or a third base side of the common focal point, and wherein the second location comprises a location in an outfield of the sports field.

22. The method of claim 21, wherein predicting the physical point where the ball passed over the common focal point comprises:

determining, by the one or more processors and based on the video stream captured by the first camera, a time which the ball crossed a plane that includes the virtual strike zone;

determining, by the one or more processors, a location of the ball in the video stream captured by the second camera at the time which the ball crossed the plane that includes the virtual strike zone;

determining, by the one or more processors, whether the location of the ball in the video stream captured by the second camera at the time which the ball crossed the plane that includes the virtual strike zone is inside the virtual strike zone or outside the virtual strike zone;

in response to determining that the location is inside the virtual strike zone, determining, by the one or more processors, that the pitch is a strike; and in response to determining that the location is outside the virtual strike zone, determining, by the one or more processors, that the pitch is a ball.

23. The method of claim 17, further comprising:

determining, by the one or more processors, a degree offset for each of one or more of the plurality of cameras, the degree offset comprising a number of degrees away from 90 degrees the respective camera makes when triangulated at the common focal point.

24. The method of claim 17, wherein the plurality of cameras further includes a third camera located at a third location different than each of the first location and the second location, wherein the first location comprises a location approximately even with the common focal point on one of a first base side of the common focal point or a third base side of the common focal point, wherein the second location comprises a location in an outfield of the sports field, and wherein the third location comprises a location approximately behind the common focal point.

25. The method of claim 24, wherein the plurality of cameras further comprises a fourth camera at a fourth location different than each of the first location, the second location, and the third location.

26. The method of claim 25, wherein the plurality of cameras further comprises a fifth camera at a fifth location different than each of the first location, the second location, the third location, and the fourth location.

27. A device comprising:

a non-transitory computer-readable storage medium; and one or more processors configured to:

control one or more cameras to each capture an individual video stream, each of the one or more cameras being directed at a common focal point on a sports field;

detect a batter near the common focal point in each of the individual video streams;

construct a virtual strike zone above the common focal point and in front of the batter based at least in part on each of the individual video streams and one or more of one or more stance characteristics of the batter and one or more physical characteristics of the batter;

detect a pitching motion performed by a pitcher within one or more of the individual video streams;

identify a ball leaving a hand of the pitcher within one or more of the individual video streams;

in response to identifying the ball, track the ball within one or more of the individual video streams as the ball travels towards the common focal point;

predict, based on the tracking of the ball, a physical point where the ball passed over the common focal point;

determine whether the physical point where the ball passed over the common focal point is within the virtual strike zone;

in response to determining that the physical point where the ball passed over the common focal point is within the virtual strike zone, send, to a user device, an indication of a strike call; and receive, from the user device, and in response to sending the indication of the ball or the indication of the strike to the user device, a confirmation of the received indication or a reversal of the received indication.

28. A non-transitory computer-readable storage medium having stored thereon instructions that, when executed, cause one or more processors of a computing device to:

control one or more cameras to each capture an individual video stream, each of the one or more cameras being directed at a common focal point on a sports field;

detect a batter near the common focal point in each of the individual video streams;

construct a virtual strike zone above the common focal point and in front of the batter based at least in part on each of the individual video streams and one or more of one or more stance characteristics of the batter and one or more physical characteristics of the batter;

detect a pitching motion performed by a pitcher within one or more of the individual video streams;

identify a ball leaving a hand of the pitcher within one or more of the individual video streams;

in response to identifying the ball, track the ball within one or more of the individual video streams as the ball travels towards the common focal point;

predict, based on the tracking of the ball, a physical point where the ball passed over the common focal point;

determine whether the physical point where the ball passed over the common focal point is within the virtual strike zone;

in response to determining that the physical point where the ball passed over the common focal point is within the virtual strike zone, send, to a user device, an indication of a strike call; and receive, from the user device, and in response to sending the indication of the ball or the indication of the strike to the user device, a confirmation of the received indication or a reversal of the received indication.

* * * * *